US005920933A

United States Patent [19]

Chou

[11] Patent Number: 5,920,933

[45] Date of Patent: Jul. 13, 1999

[54] PILLOW

[76] Inventor: Chao-Mu Chou, 4F, No. 14, Alley 11, Lane 123 Section 3, Jen-Ai Road, Taipei, Taiwan

[21] Appl. No.: 09/104,125

[22] Filed: Jun. 24, 1998

[51] Int. Cl.[6] ..... A47C 20/02

[52] U.S. Cl. ..... 5/636; 5/640; 5/417; 5/630

[58] Field of Search ..... 5/636, 640, 922, 5/630, 632, 655, 417

[56] References Cited

U.S. PATENT DOCUMENTS

| | | | |
|---|---|---|---|
| 2,720,654 | 10/1955 | Stephenson | 5/417 X |
| 4,231,125 | 11/1980 | Tittl | 5/419 |
| 4,656,670 | 4/1987 | Schluter | 5/417 X |
| 4,908,893 | 3/1990 | Smit | 5/636 X |
| 5,210,891 | 5/1993 | Avital et al. | 5/420 |
| 5,310,245 | 5/1994 | Lyszczasz | 5/922 X |
| 5,535,467 | 7/1996 | Ciske | 5/636 |
| 5,737,785 | 4/1998 | Casey | 5/417 X |

*Primary Examiner*—Brian K. Green
*Assistant Examiner*—Rodrigo J. Morales
*Attorney, Agent, or Firm*—Dougherty & Troxell

[57] ABSTRACT

An improved pillow including a rectangular pillow fabric of a washable material, a first fastening means disposed on one side of the pillow fabric a certain distance from one end thereof transverse to a longitudinal axis thereof, and a second fastening means disposed on the other side of the pillow fabric corresponding to the first fastening means such that the first and second fastening means are fastenable together when the pillow fabric is rolled up from the one end to form a scroll-like rolled-up portion.

6 Claims, 4 Drawing Sheets

PILLOW

BACKGROUND OF THE INVENTION (a) Field of the Invention

The present invention relates generally to a pillow, and more particularly to a pillow that is washable to ensure personal hygiene and that conforms to ergonomic and medical requirements to ensure a healthy sleep.

(b) Description of the Prior Art

Conventional pillows generally fall into two main types. In one type, a filing such as cotton, beans, husks, etc. is stuffed into a generally rectangular enclosed inner pillowcase. In the other type, a soft high polymer material such as foamed polyester is used to form an integral packing which is enclosed by the inner pillowcase. Pillows are used for a relatively long time. However, they are mostly not washable. Only the outer pillowcases are washable.

Medical reports show that bacteria may breed and dust may accumulate in the filling or packing of the pillow, which is injurious to health, especially the skin and the respiratory organs.

Seen from an ergonomic viewpoint, a good pillow should include front and rear raised portions with a depression therebetween so that the user's head may rest on the front raised portion. However, conventional pillows are generally rectangular with a raised central portion and four sloping corner portions, which is not ergonomic for sleeping purposes.

SUMMARY OF THE INVENTION

A primary object of the present invention is to provide an improved pillow which is washable to ensure personal hygiene, and which conforms to the ergonomic and medical requirements to ensure healthy sleep.

According to the present invention, an improved pillow comprises a rectangular pillow fabric of a washable material, a first fastening means disposed on one side of the pillow fabric a certain distance from one end thereof transverse to a longitudinal axis thereof, and a second fastening means disposed on the other side of the pillow fabric corresponding to the first fastening means such that the first and second fastening means are fastenable together when the pillow fabric is rolled up from the one end to form a scroll-like rolled-up portion.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
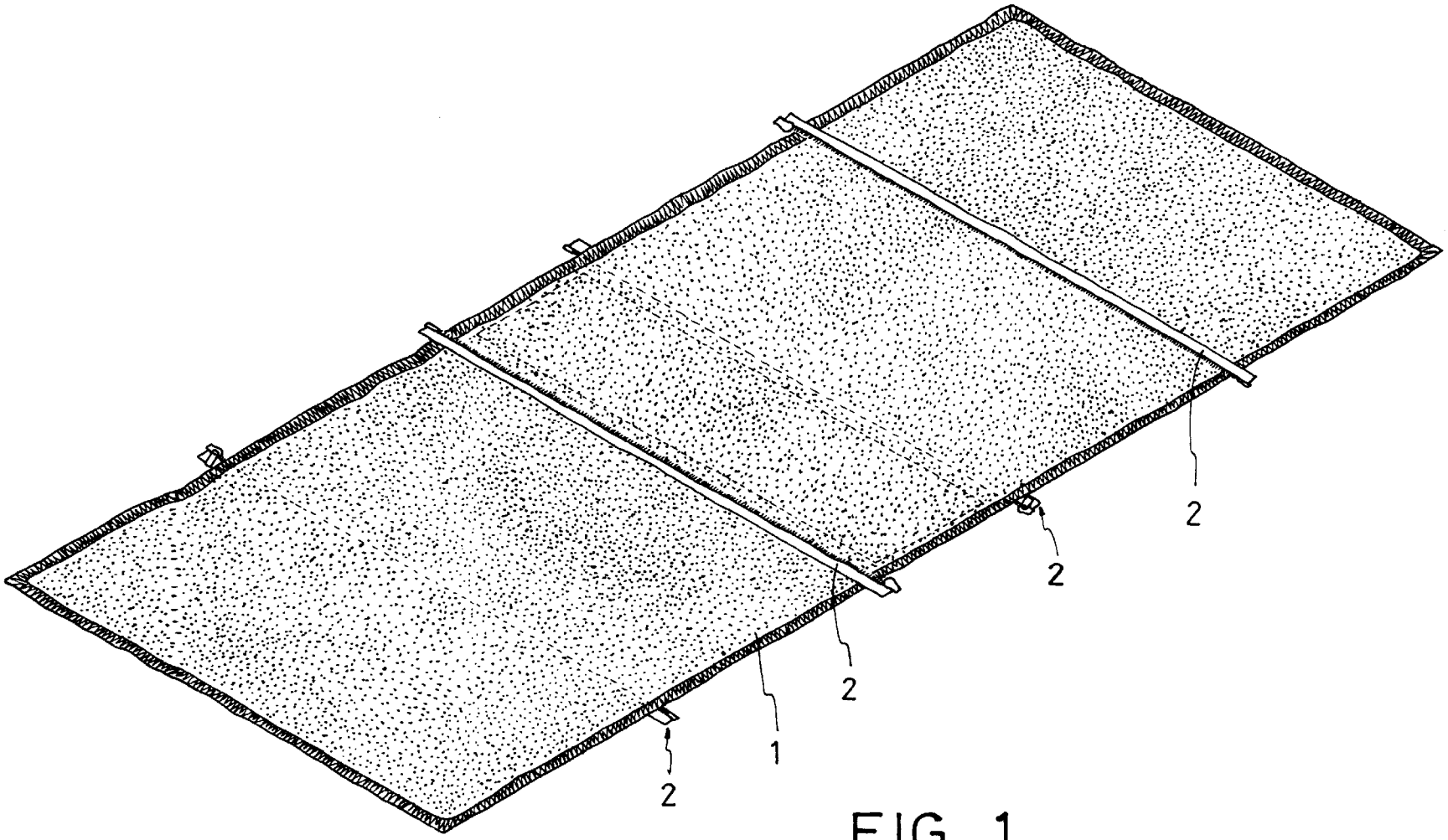
FIG. 1 is a perspective view of the first embodiment of a pillow according to the present invention in an extended state.
Figure 2:
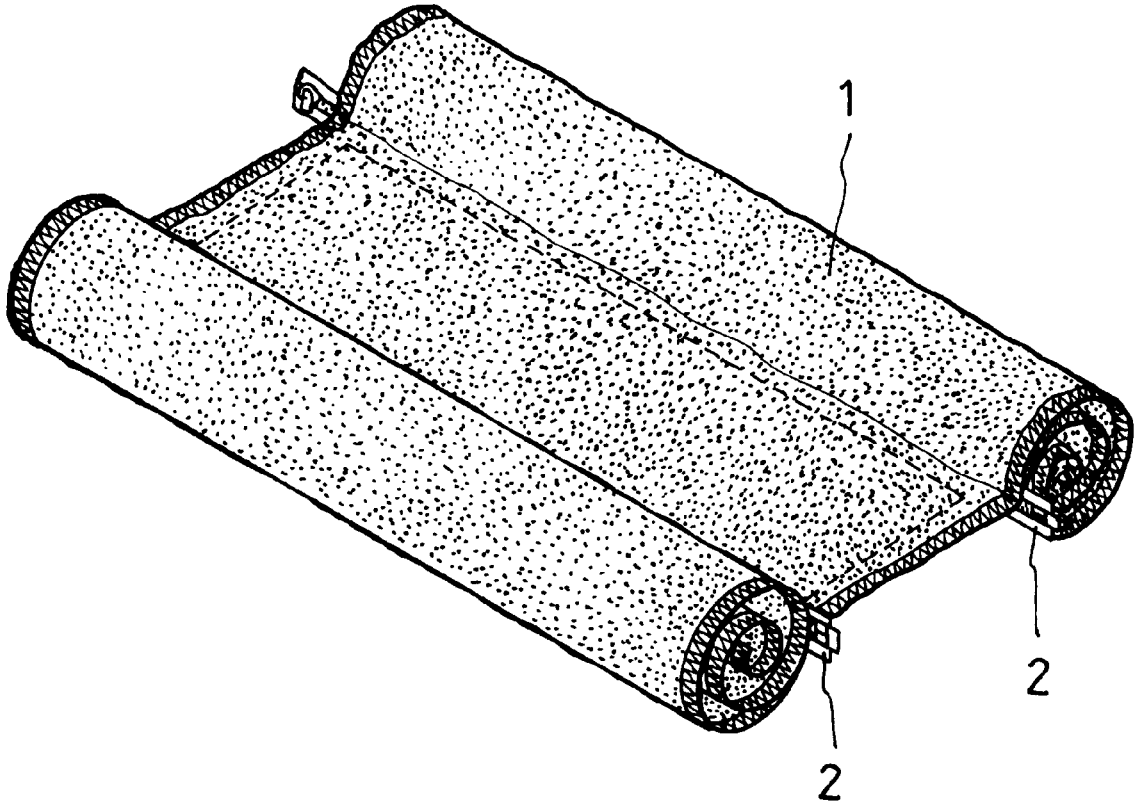
FIG. 2 is a perspective view of the first embodiment showing the pillow in a rolled-up state.
Figure 3:
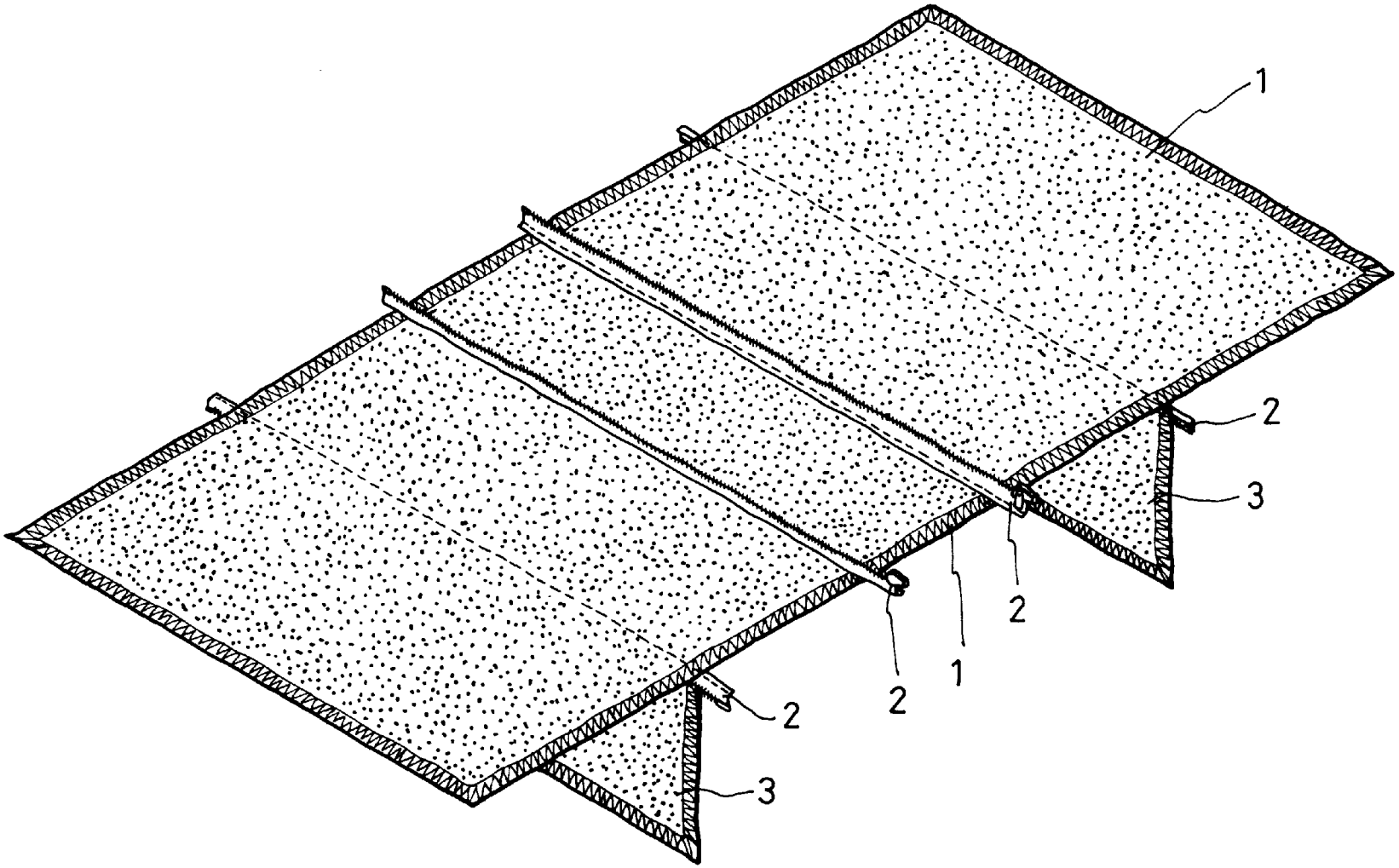
FIG. 3 is a perspective view of the second embodiment of the pillow according to the present invention showing the reverse side of the pillow in an extended state.

With reference to FIGS. 1–3, the present invention is shown to comprise a rectangular pillow fabric 1 of a fibrous material of a relatively large thickness, and fastening means 2.

The pillow fabric 1 is preferably made of natural fibers or synthetic fibers so that it is washable. Besides, to increase its thickness and softness, napped cloth or loosely woven yarn is preferred. Alternatively, multiple layers of woven cloth may be stacked together to form the pillow fabric 1 but should be washable.

The present invention is characterized in that fastening means 2 are provided on both sides of the pillow fabric 1 a certain distance from distal ends of the pillow fabric 1 such that they are transverse to the longitudinal axis of the pillow fabric 1. The fastening means 2 on one side of the pillow fabric 1 are engageable with the fastening means on the other side. Examples of such fastening means 2 are zippers, buttons, hook-and-loop tapes, etc. In the embodiments shown in the drawings, the fastening means 2 are arranged near the left and right ends of the pillow fabric 1. It should be understood that they can be arranged at any suitable positions.

In actual use, the pillow fabric 1 may be rolled inwardly from the ends as shown in FIG. 2 so that it resembles a scroll with two reels on both ends of a certain height and the fastening means 2 on one side engage those on the other side.

Therefore, when the fastening means 2 are fastened in position, a pillow having two reels of a certain height are formed on both ends thereof on which the user may put his/her head. The depression thus formed between the reels may be adapted to receive a cooling pillow for a patient's use, for instance. After the pillow fabric 1 has been rolled in the form as shown, a pillowcase may be slipped over it just like a conventional pillow. As this is well known, it will not be discussed further herein.

The fastening means 2 may be disengaged so that the pillow fabric 1 returns to its original rectangular shape. The pillow fabric 1 may then be put into the washing machine to clean. Personal hygiene is therefore ensured.

Figure 4:
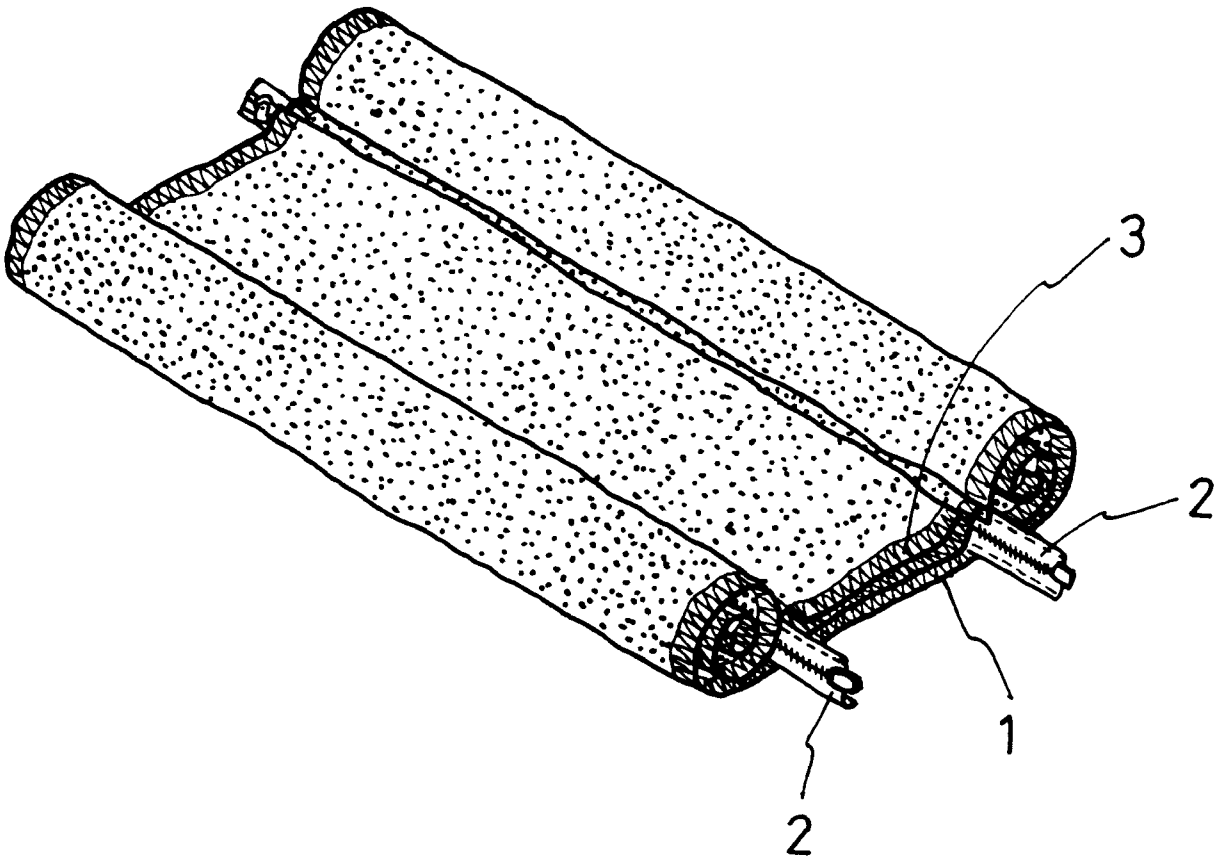
FIG. 4 is a perspective view of the second embodiment in a rolled-up state.

FIGS. 3 and 4 show another preferred embodiment of the present invention. In order to reduce the difference in height between the rolled-up portions at both sides of the pillow and the depression in the middle, flaps 3 may be provided near the fastening means 2 such that when the pillow fabric 1 is rolled up, the flaps 3 may cover the depression between the rolled-up portions. In this way, an article such as a cooling pillow disposed in the depression may also be covered. The flaps 3 may be provided with one or two fasts means 2. The embodiment shown in FIGS. 3 and 4 show that two fastening means 2 are provided so that there are double layers of fabric in the depression between the roiled-up portions on both sides after the pillow fabric 1 is rolled up.

It can therefore be appreciated from the above that the pillow according to the present invention is in keeping with ergonomic and medical uses. Besides, it can be extended for washing purposes to solve the problem of hygiene. All these advantages are not achievable by the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A pillow comprising:

a) a rectangular pillow fabric of washable material having a width bounded by opposite sides, a length greater than the width, and first and second opposite surfaces;

b) a plurality of first discrete fastening devices attached to the first surface of the pillow fabric, each first fastening device extending transversely to the length and extending beyond both opposite sides of the pillow fabric; and, c) a plurality of second discrete fastening devices attached to the second surface of the pillow fabric, each second fastening device extending across the width transversely to the length and extending beyond both opposite sides of the pillow fabric, each second fastening device being releasably attachable to one of the plurality of first fastening devices to releasably hold the pillow fabric in a rolled-up scroll position.

2. The pillow as defined in claim 1, wherein the pillow fabric comprises a plurality of layers of woven cloth.

3. The pillow as defined in claim 1, wherein each of the first and second fastening devices comprises engaging zipper portions.

4. The pillow as defined in claim 1, further comprising a pillowcase enclosing the pillow fabric after it is rolled up.

5. The pillow as defined in claim 1, wherein the pillow fabric comprises a napped cloth.

6. The pillow as defined in claim 1, further comprising a plurality of flaps attached to one of the opposite surfaces of the pillow fabric, one flap being adjacent to each of the plurality of fastening devices attached to said one of the opposite surfaces so as to cover a depression formed between two rolled-up portions after the pillow fabric is rolled up.

* * * * *